US011602012B2

(12) United States Patent
Unno et al.

(10) Patent No.: US 11,602,012 B2
(45) Date of Patent: Mar. 7, 2023

(54) WAFER PLACEMENT TABLE AND METHOD FOR MANUFACTURING THE SAME

(71) Applicant: NGK INSULATORS, LTD., Nagoya (JP)

(72) Inventors: Yutaka Unno, Handa (JP); Shuichiro Motoyama, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 349 days.

(21) Appl. No.: 16/898,772

(22) Filed: Jun. 11, 2020

(65) Prior Publication Data

US 2021/0007181 A1 Jan. 7, 2021

(30) Foreign Application Priority Data

Jul. 1, 2019 (JP) ..... JP2019-122749

(51) Int. Cl.

| | |
|---|---|
| ***H05B 3/68*** | (2006.01) |
| ***H05B 1/02*** | (2006.01) |
| ***H05B 3/74*** | (2006.01) |
| ***H05B 3/28*** | (2006.01) |

(52) U.S. Cl.

CPC ..... *H05B 1/0233* (2013.01); *H05B 3/283* (2013.01); *H05B 3/748* (2013.01); *H05B 2203/016* (2013.01)

(58) Field of Classification Search

CPC ..... H01L 21/67; H01L 21/683; H01L 21/687; H05B 3/28; H05B 3/36; H05B 3/74; H05B 6/10; H05B 1/02

USPC ..... 219/444.1

See application file for complete search history.

(56) References Cited

U.S. PATENT DOCUMENTS 5,995,357 A 11/1999 Ushikoshi et al.
6,590,760 B1 * 7/2003 Fujii ..... B32B 9/005 361/233
6,617,514 B1 9/2003 Ushikoshi et al.
(Continued)

FOREIGN PATENT DOCUMENTS

JP H10-209255 A 8/1998
KR 10-1999-0006874 A 1/1999
(Continued)

OTHER PUBLICATIONS

Taiwanese Office Action (Application No. 109119291) dated Dec. 9, 2020.
(Continued)

*Primary Examiner* — Sang Y Paik
(74) *Attorney, Agent, or Firm* — Burr Patent Law, PLLC

(57) ABSTRACT

A wafer placement table includes: a ceramic member having a wafer placement surface; a mesh electrode buried in the ceramic member; a conductive connection member in contact with the mesh electrode and exposed to outside from a surface of the ceramic member on the opposite side of the wafer placement surface; and an external current-carrying member joined to a surface of the connection member exposed to outside. The mesh electrode has a mesh opening in a region that faces the connection member, and the mesh opening is filled with a sintered conductor being a sintered body of a mixture containing a conductive powder and a ceramic raw material.

8 Claims, 4 Drawing Sheets

(56) References Cited

U.S. PATENT DOCUMENTS

| | | | | |
|---|---|---|---|---|
| 2007/0257022 | A1* | 11/2007 | Lin | H05B 3/283 219/443.1 |
| 2008/0116187 | A1* | 5/2008 | Sugimoto | H05B 3/143 219/200 |
| 2017/0069520 | A1 | 3/2017 | Unno | |

FOREIGN PATENT DOCUMENTS

| | | | |
|---|---|---|---|
| KR | 10-2010-0050388 | A | 5/2010 |
| TW | 367531 | B1 | 8/1999 |
| WO | 2015/198892 | A1 | 12/2015 |

OTHER PUBLICATIONS

Japanese Office Action (Application No. 2019-122749) dated Apr. 19, 2022 (with English translation).
Korean Office Action (Application No. 10-2020-0073529) dated Jul. 26, 2021 (with English translation).

* cited by examiner

Mesh aperture $A = \frac{25.4}{M} - d$

Mesh open area percentage $\varepsilon = \left(\frac{A}{A+d}\right)^2 \times 100$ A : Mesh aperture (mm)
M : Mesh
d : Wire deameter (mm)
$\varepsilon$ : Mesh open area percentage (%)

WAFER PLACEMENT TABLE AND METHOD FOR MANUFACTURING THE SAME

BACKGROUND OF THE INVENTION

1. Field of the Invention

The present invention relates to a wafer placement table and a method for manufacturing the wafer placement table.

2. Description of the Related Art

For example, the wafer placement table described in PTL 1 is known. PTL 1 discloses a wafer placement table including a ceramic member, a mesh electrode, a conductive connection member, and an external current-carrying member. The ceramic member has a wafer placement surface. The mesh electrode is buried in the ceramic member. The connection member is in contact with the mesh electrode and exposed to outside from a surface of the ceramic member on the opposite side of the wafer placement surface. The external current-carrying member is jointed to a surface of the connection member exposed to outside with a joining layer interposed therebetween.

CITATION LIST

Patent Literature

PTL 1: WO 2015/198892

SUMMARY OF THE INVENTION

However, the connection member is in line contact with the mesh electrode, and the substantial contact area between the connection member and the mesh electrode is small accordingly. Thus, the amount of heat generation adjacent to the connection member when a current flows into the mesh electrode from the external current-carrying member through the connection member is large. This may impair the uniformity of heating on a wafer.

The present invention has been made to solve such a problem. A main object of the present invention is to reduce heat generation of a connection member when a current flows into a mesh electrode.

A wafer placement table of the present invention includes:

a ceramic member having a wafer placement surface;

a mesh electrode buried in the ceramic member;

a conductive connection member in contact with the mesh electrode and exposed to outside from a surface of the ceramic member on the opposite side of the wafer placement surface; and an external current-carrying member joined to a surface of the connection member, the surface being exposed to outside, wherein the mesh electrode has a mesh opening in a region that faces the connection member, and the mesh opening is filled with a sintered conductor being a sintered body of a mixture containing a conductive powder and a ceramic raw material.

In this wafer placement table, the mesh electrode has mesh openings in a region that faces the connection member, the mesh openings are filled with a sintered conductor. The sintered conductor is a sintered body of a mixture containing a conductive powder and a ceramic raw material (granule or powder). The connection member is in contact with wires of the mesh electrode and in contact with the mesh electrode with the sintered conductor interposed therebetween. Thus, the substantial contact area between the connection member and the mesh electrode is larger than that in the related art. Accordingly, the resistance between the connection member and the mesh electrode is smaller than that in the related art, and the heat generation of the connection member when a current flows into the mesh electrode from the external current-carrying member through the connection member is reduced.

In the wafer placement table according to the present invention, the mesh electrode may be a RF electrode to which a high-frequency voltage is applied. When a high-frequency voltage is applied to the mesh electrode, the connection member itself tends to generate heat due to a high-frequency current flowing into the mesh electrode from the external current-carrying member through the connection member, but the resistance between the connection member and the mesh electrode is smaller than that in the relater art as described above, which reduces heat generation of the connection member itself.

In the wafer placement table according to the present invention, the mesh opening may have a quadrilateral shape with a length of one side of 0.3 mm or more and 1 mm or less, and the conductive powder may have a particle size of 1 μm or more and 10 μm or less.

In the wafer placement table according to the present invention, the conductive powder is preferably a powder made of the same material as that of the mesh electrode. In this case, the sintered conductor and the mesh electrode have similar thermal expansion coefficients, which can prevent crack generation in the ceramic member otherwise caused by thermal stress. The thermal expansion coefficients of the conductive powder and the mesh electrode are preferably similar to the thermal expansion coefficient of the ceramic member.

A method for manufacturing a wafer placement table of the present invention includes:

(a) a step of disposing a mesh electrode on a base being a ceramic compact or ceramic fired body, and placing a conductive powder in a mesh opening in a predetermined region of the mesh electrode;

(b) a step of disposing a conductive connection member on the predetermined region of the mesh electrode;

(c) a step of producing a multilayer body by overlaying a ceramic raw material on the base so as to cover the mesh electrode and the connection member;

(d) a step of producing a ceramic member by subjecting the multilayer body to hot-press firing to integrate the base with the ceramic raw material; and (e) a step of forming a hole in the ceramic member from a surface of the ceramic member on the opposite side of a wafer placement surface so that the hole reaches the connection member, inserting an external current-carrying member into the hole, and joining the external current-carrying member to an exposed surface of the connection member.

According to the method for manufacturing the wafer placement table, the wafer placement table according to the present invention described above can be manufactured relatively easily.

DETAILED DESCRIPTION OF THE INVENTION

Figure 1:
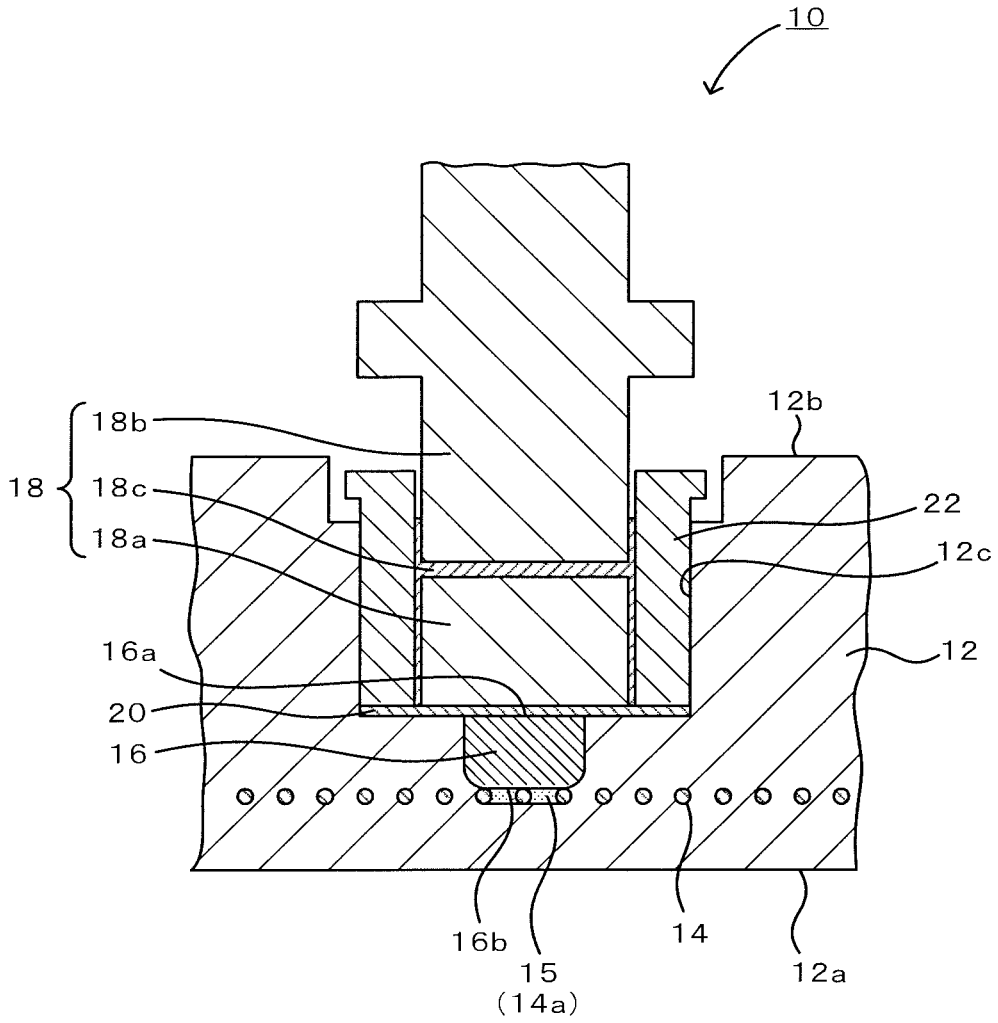
FIG. 1 is a longitudinal cross-sectional view of main parts of a wafer placement table 10.
Figure 2:
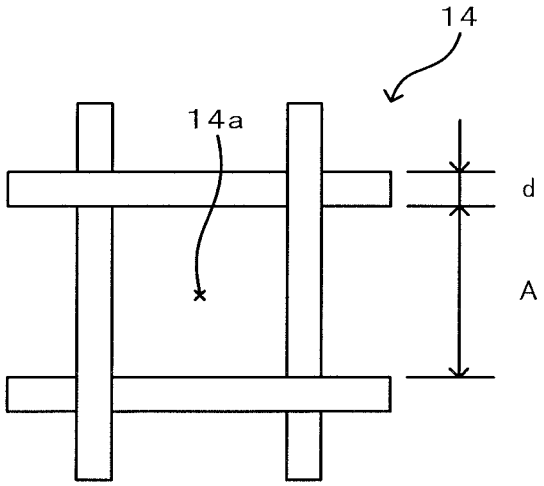
FIG. 2 is a partial plan view of a mesh electrode 14.
Figure 3A:
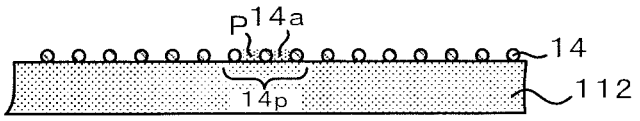
FIGS. 3A to 3E illustrate views of steps for manufacturing the wafer placement table 10.
Figure 3B:
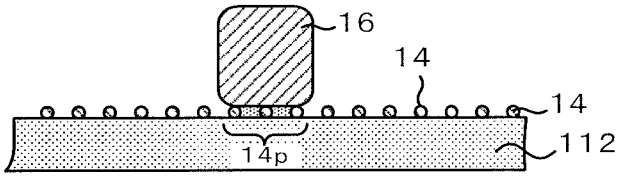
Figure 3C:
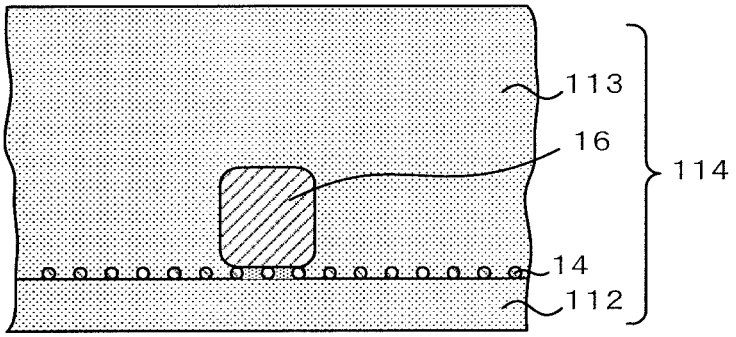
Figure 3D:
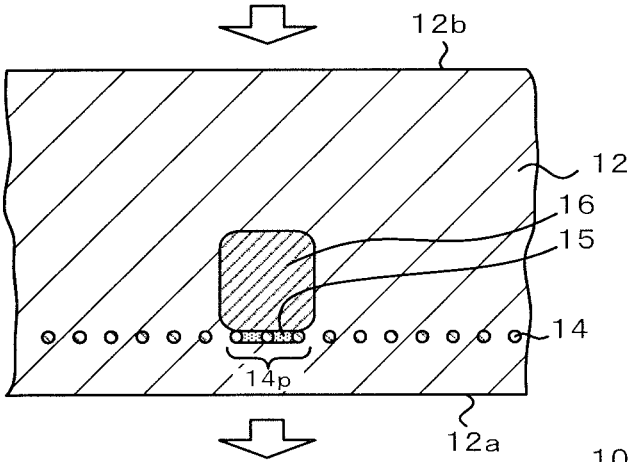
Figure 3E:
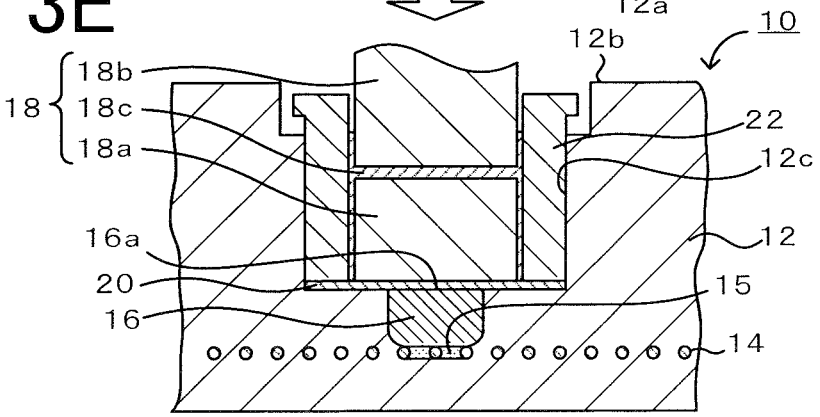

Next, a wafer placement table 10 according to a preferred embodiment of the present invention will be described below. FIG. 1 is a longitudinal cross-sectional view of main parts of the wafer placement table 10, and FIG. 2 is a partial plan view of a mesh electrode 14.

The wafer placement table 10 is used to place a wafer to be subjected to a treatment such as etching or CVD. The wafer placement table 10 is installed in a vacuum chamber (not shown). The wafer placement table 10 includes a ceramic member 12, a mesh electrode 14, a sintered conductor 15, a connection member 16, an external current-carrying member 18, and a guide member 22.

The ceramic member 12 is formed in a circular plate shape, and one surface of the ceramic member 12 is a wafer placement surface 12*a* for placing a wafer. In FIG. 1, the wafer placement surface 12*a* faces downward. In actual use of the wafer placement table 10, the wafer placement surface 12*a* faces upward. The material of the ceramic member 12 is preferably, for example, aluminum nitride, aluminum oxide, silicon carbide, silicon nitride, or the like. A hole 12*c* having a bottomed cylindrical shape is formed in a surface 12*b* of the ceramic member 12 on the opposite side of the wafer placement surface 12*a*. The ceramic member 12 may have, for example, a diameter of 150 to 500 mm and a thickness of 0.5 to 30 mm. The hole 12*c* may have, for example, a diameter of 5 to 15 mm and a depth of 5 to 25 mm.

The mesh electrode 14 is a RF electrode (an electrode to which a high-frequency voltage is applied) buried in the ceramic member 12 and is a circular metal mesh disposed along the wafer placement surface 12*a*. The material of the mesh electrode 14 is preferably, for example, tungsten, molybdenum, niobium, tantalum, platinum, an alloy thereof, a compound thereof, or the like. In the mesh electrode 14 illustrated in FIG. 2, the mesh aperture (the length of one side of a quadrilateral mesh opening 14*a*) A, the mesh (the number of meshes within one inch of warp wire and one inch of weft wire) M, the wire diameter d, and the mesh open area percentage E are not limited. The mesh aperture A is preferably 0.3 mm or more and 1 mm or less, the mesh M is preferably 10 or more and 100 or less, the wire diameter d is preferably 0.1 mm or more and 1 mm or less, and the mesh open area percentage E is preferably 40% or more and 60% or less.

The sintered conductor 15 is a sintered body of a mixture containing a conductive powder P and a ceramic raw material (granule or powder). The mesh openings 14*a* in a region of the mesh electrode 14 that faces the connection member 16 are filled with the sintered conductor 15. The sintered conductor 15 is in contact with the side surfaces of wires of the mesh electrode 14 and in contact with a horizontal surface 16*b* of the connection member 16. The material of the conductive powder P contained in the sintered conductor 15 is preferably a material having a thermal expansion coefficient similar to that of the mesh electrode 14 and more preferably the same as the material of the mesh electrode 14. The thermal expansion coefficients of the mesh electrode 14 and the conductive powder P are preferably similar to the thermal expansion coefficient of the ceramic member 12. For example, when the material of the ceramic member 12 is aluminum nitride, the material of the mesh electrode 14 and the conductive powder P is preferably a molybdenum compound, such as molybdenum, tungsten, or molybdenum carbide, or a tungsten compound, such as tungsten carbide. When the material of the ceramic member 12 is aluminum oxide, the material of the mesh electrode 14 and the conductive powder P is preferably a niobium compound, such as niobium or niobium carbide.

The connection member 16 is a cylindrical metal member buried in the ceramic member 12 so as to reach the mesh electrode 14 from the bottom surface of the hole 12*c*. The connection member 16 may be formed of bulk metal or may be formed of sintered metal powder. The material of the connection member 16 preferably has a thermal expansion coefficient similar to that of the ceramic member 12 or has a thermal expansion coefficient similar to that of the mesh electrode 14 and the conductive powder P. The material of the connection member 16 is preferably the same as the material of the mesh electrode 14 and the conductive powder P. An exposed surface 16*a* of the connection member 16 exposed on the bottom surface of the hole 12*c* is flush with the bottom surface of the hole 12*c*. The connection member 16 preferably has a diameter of 2 to 5 mm and preferably has a height of 1 to 5 mm.

The external current-carrying member 18 includes a first part 18*a* and a second part 18*b*. The first part 18*a* is joined to the connection member 16 with the conductive joining layer 20 interposed therebetween. The second part 18*b* is joined to a surface of the first part 18*a* on the opposite side of the joint surface of the connection member 16 with an intermediate joint 18*c* interposed therebetween. The second part 18*b* is made of a highly oxidation-resistant metal in consideration of use in a plasma atmosphere or corrosive gas atmosphere. However, a highly oxidation-resistant metal typically has a large thermal expansion coefficient. If the second part 18*b* is directly joined to the connection member 16, the joint strength is low due to a difference in thermal expansion between the second part 18*b* and the connection member 16. Thus, the second part 18*b* is joined to the ceramic member 12 with, interposed therebetween, the first part 18*a* made of a metal having a thermal expansion coefficient similar to the thermal expansion coefficient of the connection member 16. Such a metal often has insufficient oxidation resistance. Thus, the first part 18*a* is surrounded by the guide member 22 made of a highly oxidation-resistant metal to prevent direct contact with a plasma atmosphere or corrosive gas atmosphere. The material of the second part 18*b* is preferably pure nickel, nickel-based heat-resistant alloy, gold, platinum, silver, an alloy thereof, or the like. The material of the first part 18*a* is preferably molybdenum, tungsten, molybdenum-tungsten alloy, tungsten-copper-nickel alloy, Kovar, or the like. The joining layer 20 is joined by using a brazing material. The brazing material is preferably a metal brazing material and preferably, for example, an Au—Ni brazing material, an Al brazing material, an Ag brazing material, or the like. The joining layer 20 joins the end surface of the first part 18*a* to the bottom surface of the hole 12*c* including the exposed surface 16*a* of the connection member 16. The intermediate joint 18*c* of the external current-carrying member 18 joins the first part 18*a* and the second part 18*b* together and fills in a gap between the inner circumferential surface of the guide member 22 and the entire or part of the outer circumferential surface of the first part 18*a* and a gap between the inner circumferential surface of the guide member 22 and part of the outer circumferential surface of the second part 18*b*. Thus, the intermediate joint 18*c* prevents the first part 18*a* from contact with the surrounding atmosphere. The intermediate joint 18*c* can be made of the same material as that of the joining layer 20. The first part 18*a* may have a diameter of 3 to 6 mm and a height of 2 to 5 mm. The second part 18*b* may have a diameter of 3 to 6 mm and any height.

The guide member 22 is a hollow cylindrical member that surrounds at least the first part 18*a* of the external current-carrying member 18 and is made of a material having higher oxidation resistance than the first part 18*a*. The guide member 22 has an inner diameter larger than the outer diameter of the first part 18*a* and the second part 18*b*, an outer diameter (excluding the flange) smaller than the diameter of the hole 12*c*, and a height higher than the height of the first part 18*a*. An end surface of the guide member 22 that faces the bottom surface of the hole 12*c* is joined to the connection member 16, the external current-carrying member 18, and the ceramic member 12 with the joining layer 20 interposed therebetween. The materials exemplified as the material of the second part 18*b* of the external current-carrying member 18 can be used as the material of the guide member 22.

Next, an example of use of the wafer placement table 10 will be described. The wafer placement table 10 is disposed in a chamber (not shown) such that the wafer placement surface 12*a* faces upward, and a wafer is placed on the wafer placement surface 12*a*. Plasma is generated between parallel plate electrodes, which include a counter horizontal electrode (not shown) installed in an upper part of the chamber and the mesh electrode 14 buried in the wafer placement table 10, by applying an alternating current high frequency voltage of a RF power supply (not shown) to the mesh electrode 14 through the external current-carrying member 18, the joining layer 20, and the connection member 16. This plasma is used to perform CVD film formation or etching on the wafer.

Next, an example of manufacture of the wafer placement table 10 will be described based on the views of manufacturing steps shown in FIGS. 3A to 3E. First, a mesh electrode 14 is disposed on the upper surface of a base 112, which is a ceramic compact formed by press molding a ceramic raw material (granule or powder) into a circular plate, and a conductive powder P is placed in mesh openings 14*a* in a predetermined region 14*p* of the mesh electrode 14 (see FIG. 3A). The predetermined region 14*p* is a region on which a connection member 16 is to be disposed. It is noted that the lower surface of the base 112 will serve as the top surface of the wafer placement table 10 after processing and will finally serve as a wafer placement surface 12*a*. Next, the connection member 16 having a cylindrical shape is disposed on the predetermined region 14*p* of the mesh electrode 14 (see FIG. 3B). In this state, the connection member 16 is in contact with the mesh electrode 14 and the conductive powder P. Next, a ceramic raw material (granule or powder) is overlaid on the base 112 so as to cover the mesh electrode 14 and the connection member 16 and subjected to press molding to form a multilayer body 114 (see FIG. 3C). The multilayer body 114 includes the base 112 and a ceramic compact 113 overlaid on the base 112. Next, the multilayer body 114 is subjected to hot-press firing to integrate the base 112 with the ceramic compact 113 and thus to form a ceramic member 12 (see FIG. 3D). In this process, the conductive powder P placed in the mesh openings 14*a* in the predetermined region 14*p* is sintered in the state of being mixed with the ceramic raw material to form a sintered conductor 15. Next, a hole 12*c* is formed in the ceramic member 12 from a surface 12*b* of the ceramic member 12 on the opposite side of the wafer placement surface 12*a* so that the hole reaches the connection member 16, the component parts of an external current-carrying member 18 are inserted into the hole 12*c*, and the external current-carrying member 18 is joined to an exposed surface 16*a* of the connection member 16 to provide the wafer placement table 10 (see FIG. 3E). In forming the hole 12*c*, processing is performed such that the bottom surface of the hole 12*c* becomes flush with the exposed surface 16*a* of the connection member 16. In joining the component parts of the external current-carrying member 18 to the exposed surface 16*a* of the connection member 16, a brazing material serving as a joining layer 20 is applied to the bottom surface of the hole 12*c*, and a first part 18*a* of the external current-carrying member 18, a brazing material serving as an intermediate joint 18*c*, and a second part 18*b* of the external current-carrying member 18 are stacked in this order on the brazing material serving as the joining layer 20. At the same time, a guide member 22 is disposed around the stacked parts, and the brazing material is then melted by performing heating under non-oxidizing conditions and then solidified, providing the wafer placement table 10 shown in FIG. 1. The non-oxidizing conditions refer to conditions under vacuum or in a non-oxidizing atmosphere (e.g., an inert atmosphere, such as an argon atmosphere or a nitrogen atmosphere). According to the above manufacturing method, the wafer placement table 10 can be manufactured relatively easily.

In the wafer placement table 10 according to this embodiment described above, the mesh openings 14*a* in a region of the mesh electrode 14 that faces the connection member 16 are filled with the sintered conductor 15. The connection member 16 is in contact with wires of the mesh electrode 14 and in contact with the mesh electrode 14 with the sintered conductor 15 interposed therebetween. Thus, the substantial contact area between the connection member 16 and the mesh electrode 14 is larger than that in a case where the sintered conductor 15 is absent. Accordingly, the resistance between the connection member 16 and the mesh electrode 14 is smaller than that in a case where the sintered conductor 15 is absent, and the heat generation of the connection member 16 when a current flows into the mesh electrode 14 from the external current-carrying member 18 through the connection member 16 is reduced. Therefore, the connection member 16 is less likely to become a hot spot, which improves the uniformity of heating on a wafer.

In particular, when a high-frequency voltage is applied to the mesh electrode 14, the connection member 16 itself tends to generate heat due to a high-frequency current flowing into the mesh electrode 14 from the external current-carrying member 18 through the connection member 16, but the resistance between the connection member 16 and the mesh electrode 14 is small as described above, which reduces heat generation of the connection member 16 itself.

The mesh opening 14*a* preferably has a quadrilateral shape with a length of one side of 0.3 mm or more and 1 mm or less, and the conductive powder P preferably has a particle size of 1 μm or more and 10 μm or less.

Furthermore, the conductive powder P is preferably a powder made of the same material as that of the mesh electrode 14. In this case, the sintered conductor 15 and the mesh electrode 14 have the same thermal expansion coefficient, which can prevent crack generation in the ceramic member 12 otherwise caused by thermal stress.

Figure 4:
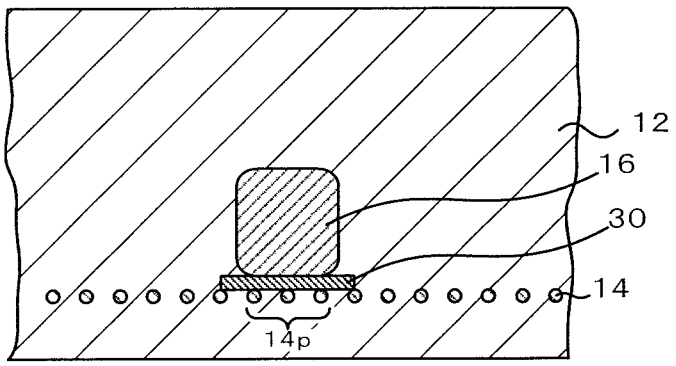
FIG. 4 is a longitudinal cross-sectional view of main parts in Reference Example 1.
Figure 5:
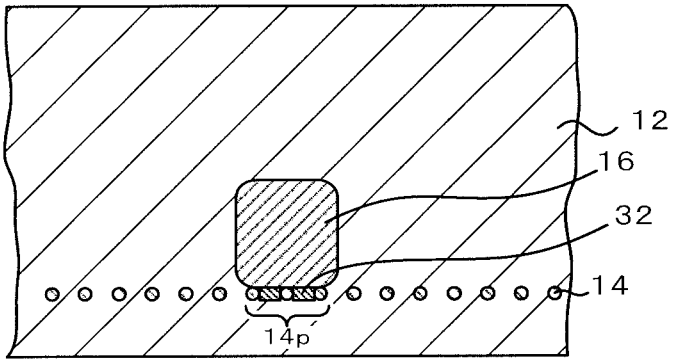
FIG. 5 is a longitudinal cross-sectional view of main parts in Reference Example 2.
Figure 6:
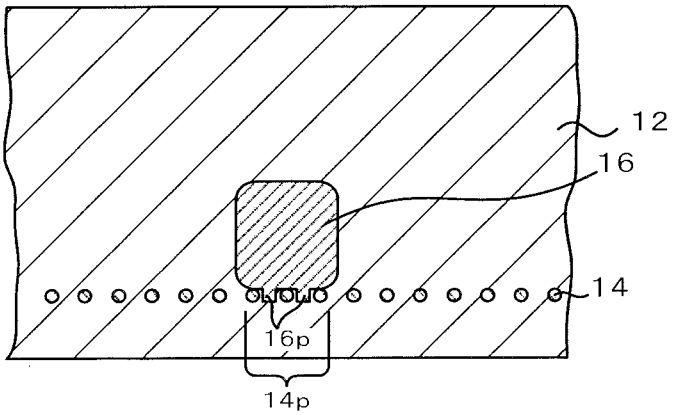
FIG. 6 is a longitudinal cross-sectional view of main parts in Reference Example 3.

For information, the inventors of the present invention have considered employing a structure (Reference Example 1, see FIG. 4) in which a metal foil 30 is disposed on a predetermined region 14*p* of a mesh electrode 14 and a connection member 16 is placed on the metal foil 30, a structure (Reference Example 2, see FIG. 5) in which a metal foil 32 is fitted into mesh openings in a predetermined region 14*p* of a mesh electrode 14, or a structure (Reference Example 3, see FIG. 6) in which protrusions 16*p* of a connection member 16 that protrude from the lower surface of the connection member 16 are inserted into mesh openings in a predetermined region 14*p* of a mesh electrode 14, instead of formation of the sintered conductor 15 by filling the mesh openings 14*a* in the predetermined region 14*p* with the conductive powder P. However, in the structure shown in FIG. 4, cracks were generated from an edge of the metal foil 30 when the ceramic member 12 was produced by hot-press firing. In the structure shown in FIG. 5, the heat generation of the connection member 16 was not reduced because the contact between the metal foil 32 and the connection member 16 which were buried in the ceramic member 12 was insufficient. In the structure shown in FIG. 6, cracks were generated from the tips of the protrusions 16*p* inserted into the mesh openings when the ceramic member 12 was produced by hot-press firing. The sintered conductor 15 according to the embodiment described above is a mixture of a conductive powder and a ceramic raw material (granule or powder) and has fluidity unlike the metal foil 32 during hot-press firing. This feature may suppress crack generation.

The present invention is not limited to the above-described embodiments, and can be carried out by various modes as long as they belong to the technical scope of the invention.

For example, in the above embodiment, the mesh electrode 14 serving as a RF electrode is buried in the ceramic member 12. In addition to the mesh electrode 14, an electrostatic electrode for attracting a wafer to the wafer placement surface 12*a* may be buried, or a heater electrode (resistance heating element) for heating a wafer may be buried.

In the above embodiment, the mesh electrode 14 is used as a RF electrode. However, the mesh electrode 14 may be used as an electrostatic electrode or may be used as a heater electrode (resistance heating element).

In the above embodiment, the wafer placement surface 12*a* may be a flat surface or may be a surface having many protrusions formed by embossing or the like.

In the above embodiment, a hollow cylindrical shaft made of the same material as that of the ceramic member 12 may be disposed on the surface 12*b* of the wafer placement table 10 on the opposite side of the wafer placement surface 12*a* and integrated with the ceramic member 12. In this case, the external current-carrying member 18 and the like are disposed inside the hollow of the shaft. After the shaft is integrated with the ceramic member 12, the external current-carrying member 18 is attached. To manufacture the shaft, for example, a ceramic raw material (granule or powder) is pressed by using a mold by means of CIP, fired at a predetermined temperature in a normal-pressure furnace, and processed into a predetermined size after firing. To integrate the shaft with the ceramic member 12, for example, the end surface of the shaft is abutted against the surface 12*b* of the ceramic member 12, and the shaft and the ceramic member 12 are integrated with each other by performing heating to a predetermined temperature.

In the above embodiment, the method for manufacturing the wafer placement table 10 uses a ceramic compact as the base 112. However, a ceramic sintered body may be used as the base 112, or a ceramic calcined body may be used as the base 112.

In the above embodiment, the manufacturing steps shown in FIGS. 3A to 3E are illustrated. However, the manufacturing steps are not limited to those shown in FIGS. 3A to 3E. For example, the following steps may be employed: a mesh electrode 14 is disposed on the upper surface of a ceramic green sheet, a conductive powder P is placed in mesh openings 14*a*, a connection member 16 is disposed thereon, another ceramic green sheet is further placed thereon, pressing is performed to produce a multilayer body, and the multilayer body is fired at normal pressure. In this case, in the mesh openings 14*a*, the conductive powder P is mixed with a ceramic raw material (granule or powder) in the ceramic green sheet during pressing, and the mixed material is then made into a sintered conductor in the subsequent firing at normal pressure.

The present application claims priority of Japanese Patent Application No. 2019-122749 filed on Jul. 1, 2019, the entire contents of which are incorporated herein by reference.

What is claimed is:

1. A wafer placement table comprising:

a ceramic member having a wafer placement surface;

a mesh electrode buried in the ceramic member;

a conductive connection member in contact with the mesh electrode and exposed to outside from a surface of the ceramic member on the opposite side of the wafer placement surface; and an external current-carrying member joined to a surface of the connection member, the surface being exposed to outside, wherein the mesh electrode has a mesh opening in a region that faces the connection member, and only the mesh opening is filled with a sintered conductor being a sintered body of a mixture containing a conductive powder and a ceramic raw material.

2. The wafer placement table according to claim 1, wherein the mesh electrode is a RF electrode to which a high-frequency voltage is applied.

3. The wafer placement table according to claim 1, wherein the mesh opening has a quadrilateral shape with a length of one side of 0.3 mm or more and 1 mm or less, and the conductive powder has a particle size of 1 □m or more and 10 □m or less.

4. The wafer placement table according to claim 1, wherein the conductive powder is a powder made of the same material as that of the mesh electrode.

5. A method for manufacturing a wafer placement table, the method comprising:

(a) a step of disposing a mesh electrode on a base being a ceramic compact or ceramic fired body, and placing a conductive powder in only a mesh opening in a predetermined region of the mesh electrode;

(b) a step of disposing a conductive connection member on the predetermined region of the mesh electrode;

(c) a step of producing a multilayer body by overlaying a ceramic raw material on the base so as to cover the mesh electrode and the connection member;

(d) a step of producing a ceramic member by subjecting the multilayer body to hot-press firing to integrate the base with the ceramic raw material; and (e) a step of forming a hole in the ceramic member from a surface of the ceramic member on the opposite side of a wafer placement surface so that the hole reaches the connection member, inserting an external current-carrying member into the hole, and joining the external current-carrying member to an exposed surface of the connection member.

6. The method for manufacturing a wafer placement table according to claim 5, wherein the mesh electrode is a RF electrode to which a high-frequency voltage is applied.

7. The method for manufacturing a wafer placement table according to claim 5, wherein the mesh opening has a quadrilateral shape with a length of one side of 0.3 mm or more and 1 mm or less, and the conductive powder has a particle size of 1 □m or more and 10 □m or less.

8. The method for manufacturing a wafer placement table according to claim 5, wherein the conductive powder is a powder made of the same material as that of the mesh electrode.

* * * * *